US006431791B2

(12) United States Patent
Galluccio

(10) Patent No.: US 6,431,791 B2
(45) Date of Patent: Aug. 13, 2002

(54) HOISTING MACHINE TO MOVE SEVERAL BOAT TO AND FROM LAND AND SEA SIMULTANEOUSLY

(76) Inventor: Anton Massimo Galluccio, 6, Via dello Sport, I-53011 Castellina in Chianti - Siena (IT)

( * ) Notice: Subject to any disclaimer, the term of this patent is extended or adjusted under 35 U.S.C. 154(b) by 0 days.

(21) Appl. No.: 09/803,922

(22) Filed: Mar. 13, 2001

(30) Foreign Application Priority Data

Mar. 16, 2000 (IT) ..... AR200A0013

(51) Int. Cl.[7] ..... B63C 3/08

(52) U.S. Cl. ..... 405/2; 405/3; 414/137.1; 414/141.6; 414/141.7; 212/512

(58) Field of Search ..... 405/1, 2, 3; 114/44; 212/195, 312, 324, 326; 414/137.1, 142.8, 141.6, 147.7, 141.3, 141.4

(56) References Cited

U.S. PATENT DOCUMENTS 3,252,589 A * 5/1966 Keene et al. ..... 405/3
3,287,921 A * 11/1966 Wilson et al. ..... 405/3
3,381,826 A * 5/1968 Durand ..... 212/198
3,409,153 A * 11/1968 Stearn et al. ..... 405/3
3,994,401 A * 11/1976 Tax et al. ..... 212/228
4,039,086 A * 8/1977 Ray ..... 212/278
4,067,446 A * 1/1978 Ray ..... 212/253
4,113,112 A * 9/1978 Ray ..... 212/198
4,363,411 A * 12/1982 Blair et al. ..... 212/195
4,953,488 A * 9/1990 Heidtmann ..... 405/3

* cited by examiner

*Primary Examiner*—Heather Shackelford
*Assistant Examiner*—Frederick L. Lagman
(74) *Attorney, Agent, or Firm*—Young & Thompson

(57) ABSTRACT

A fixed structure is shaped like a pier and equipped on an upper part with a slide guide. A length of the pier extends from land to a point at sea where the depth is such as to allow boats to be transported to float. A trolley slides along the pier. At least two arms extend from the trolley transverse to the pier. The arms are equipped with independent hoisting devices for harnessing the boats. The arms also have a sliding counterweight and are equipped with devices which indicate the horizontal position of the arms and control the movement of the sliding counterweight. The arms are also equipped with commands with which the hoisting devices and other motorized parts of the machine are controlled.

19 Claims, 2 Drawing Sheets

9
24
22
14
10
20
15
9

21
18
21
28
9
7
23
5
1
4
2
8
10
22
3
5
6
9
23
26

HOISTING MACHINE TO MOVE SEVERAL BOAT TO AND FROM LAND AND SEA SIMULTANEOUSLY

BACKGROUND OF THE INVENTION

The invention concerns a hoisting machine for the simultaneous transport to and from land and water of a number of boats.

Presently boats are put in or pulled out of water with the aid of special cranes installed in harbours or along canals placed near the sea or lake shores, into which said navigable canals issue.

Said hoisting machines usually consist of a crane which moves one boat at a time. Said machines are not planned to be used for emergencies, i.e. by rapidly hoisting boats and transferring them from water to land or vice versa. At the same time they are used to operate in harbours or along the containment walls of navigable canals.

There also exist locations with miles and miles of coast with no ports or canals or other facilities such as means which can lift boats and put them in water or pull them up on land.

For these reasons in those stretches of coast, boat users employ slides and rollers, thanks to which the difficulties encountered in transferring boats are reduced at least for small sized ones. Said lack of facilities which inhibits the presence of small fleets or fishing boats and also inhibits the development of tourism in those areas along said stretches of coast could be solved by building harbours and piers. However, this solution involves very high costs in terms of investment and maintenance. At the same time said structures, even if of small dimensions, alter considerably the landscape of the surrounding coastal area by modifying it irreversibly.

The environmental changes, even when funds should be available, are a valid reason to stop from carrying out along the coast structures that would increase the number of fishing days a year, and the touristic and nautical development of the area.

On the other hand, small structures that would not interfere with the currents along shores, do not supply sufficient shelter for boats in case of sudden change of weather conditions and do not allow the known means, that can be installed in these structures, to bring the boats to shore in very short time, in particular when in peak tourist periods.

The first problem encountered on coasts which are not equipped with harbours is that of placing in the water a number of boats in a short time to give the users the opportunity of using their boats, on good fishing days or to go cruising, as much as possible, which consequently helps the development of activities in connection with the sea and tourism.

A second problem which is also very important is to be able to pull the boats ashore when the weather changes rapidly for the worse, to avoid damages and dangerous situations for the people on board.

SUMMARY OF THE INVENTION

The aim of the present invention is to create a fixed structure, that will not alter the natural course of the currents along the shore, and a device which operates on said structure which can simultaneously and rapidly place in the water and transport to shore several boats, in order to solve the two problems mentioned above.

The invention that has supplied the solution to said problems consists in the combination of a fixed structure, shaped like a pier and equipped on its upper part with a slide guide, whose length extends from land to the point at sea where the depth is sufficient for the boats it transports to float, with a trolley which runs along said pier, and with at least two arms placed transversally to the said pier, supplied with hoisting devices and adequate means that are used to harness the boats, and also having a sliding counterweight saddle on said arms which are also equipped with indicating means which indicate the horizontal position of the arms, and/or of the different degrees of stress applied on the tie rod that connects the transversal arms to a central tower, with which the movement of the sliding counterweight is commanded, and having controls and means with which the hoisting devices and the other motorized parts of the machine are commanded.

Such an invention is particularly advantageous in that it allows the trolley which slides along the pier to pick up several boats from land, to lift them and then, moving along the slide guide on the pier, move them to a distance from shore where the depth of the water is sufficient for the boats to float, then to deposit them on the water, freeing them from the harnessing means, to move up and back on land to transport another group or to remain in a stand by position waiting to recover the boats from the water.

The lifting of the boats from the water operates in the same exact way: the boats are harnessed and hoisted from the water, then when the sliding trolley on the pier is transferred on land, the boats are lowered directly to assigned spots or onto a loading/unloading area to allow their owners to take them to the assigned spots or to take them away leaving the area free for the next lot of boats to be lifted from the water.

The invention is particularly advantageous because it allows the transportation of several boats into the water simultaneously and in a very short time to give the users of said boats the opportunity to get the most out of their day; in the same way the invention is also advantageous for the inverse operation. This second operation is very important when it is necessary to carry it out rapidly both when it is the end of a day or because the weather changes for the worse and should the boats not be collected they could risk being damaged by the conditions of the rough seas and the danger for the people on board is easily imaginable. Another advantage obtained with this invention is due to the fact that the pier and the slide guide on it do not alter the environment, do not modify the natural flow of water currents and therefore they do not determine any corrosion of the shore in the area around the pier.

Another advantage is the rapid dismantling of the hoisting structure, at least for routine maintenance in specifically equipped places, to ensure that safety requirements are guaranteed in time, even if it is exposed to salt water when the structure is installed on the sea.

BRIEF DESCRIPTION OF THE DRAWINGS

The invention can be easily understood in its shape and function with the aid of a detailed description herebelow and of the exemplifying drawings reproduced in the enclosed tables, in which.

DESCRIPTION OF THE PREFERRED EMBODIMENT

Figures 1, 3:
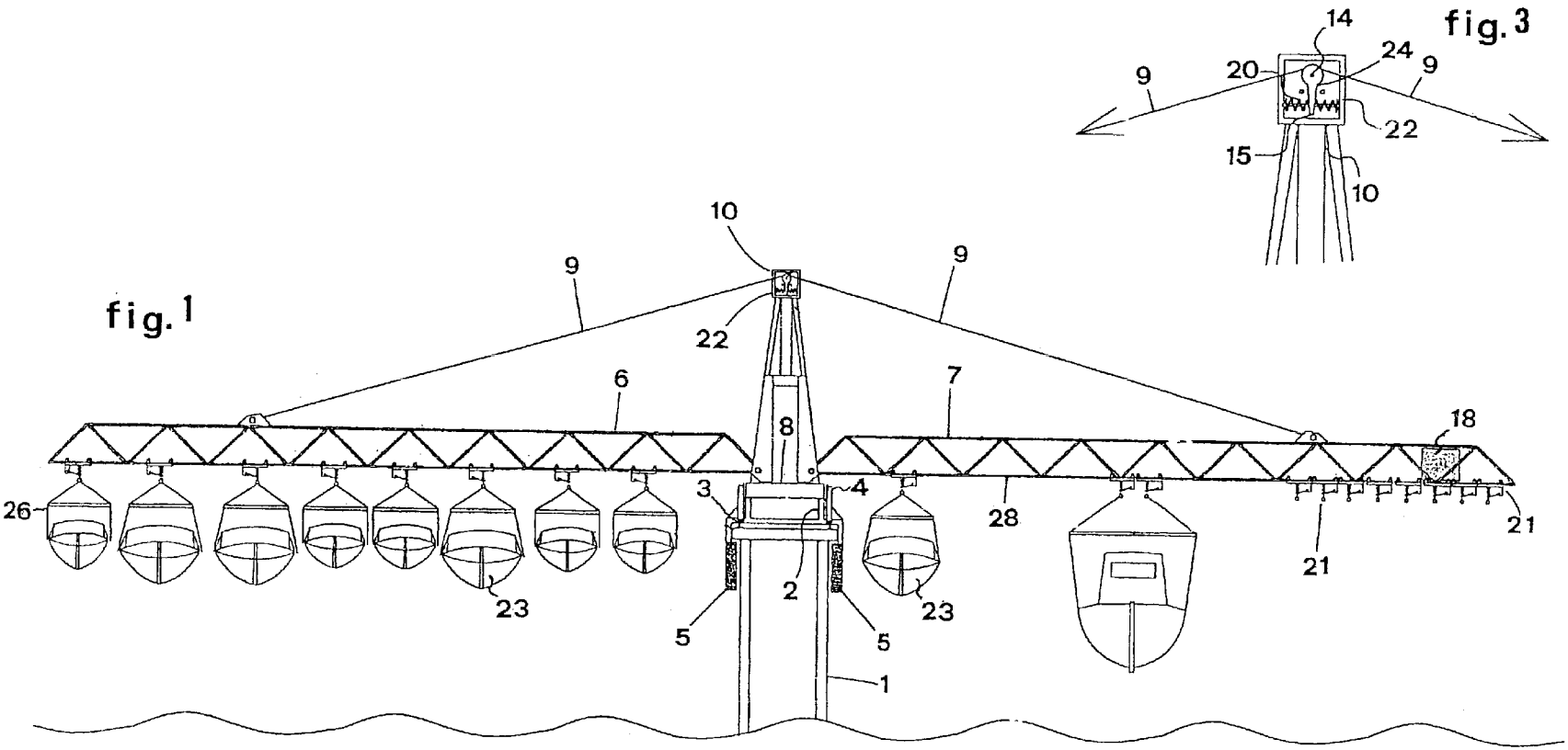
FIG. 1 is the front view of the invention in the direction in which the sliding trolley moves.
FIG. 3 is the enlarged view of the tip of the central tower of the trolley, on which the detecting device of the horizontal position of the arms of the hoisting machine is placed.

It is understood that the drawings are drafts and they are exemplifying to help understand the invention, without in any way being a limitation to it. The invention therefore consists in a machine with which several boats can be transported, in a short period of time, from land to sufficiently deep waters and vice versa.

It consists of a fixed structure 1, shaped like a pier, combined with at least a trolley 2, equipped with its own motors, operating on fuel or with electric energy from the mains or produced by specific generators, which slides along guide 3 on the pier, which extends from land, where the boats are lifted from or left, over the water to the point where the depth of the waters is sufficient for the boats that need lifting.

The slide guide 3, equipped with appropriate means to stop and limit the sliding of the trolley 2, can have different shapes: from the monorail to a common track for the movement of wheels 4 of trolley 2.

The movement is stabilized by adequate means of reaction 5, normally formed by specific counterweights, applied on trolley 2, on the parallel sides of pier 1, with which the oscillations of trolley 2 transversally to the pier are inhibited, when transversal arms 6 and 7 should undergo unbalancing stress.

The balance of trolley 2 is further increased by saddles placed on its sides, in positions overlooking the corresponding reaction guides anchored to the same pier 1, which in case of a side slip of trolley 2, would interact by blocking the tipping over sideways of the same trolley 2. Said trolley is equipped with two arms 6 and 7 placed on it, they are usually shaped like trellisses, mounted on rotating platform 8, which allows them to move from the operating position, when they are in a transversal position to pier 1, to a position in which they are lined up with the same pier, to which said arms 6 and 7 will be anchored in the time when the machine is inactive. With said solution pier 1 and hoisting trolley 2 appear like a single structure, with a minor impact on the surrounding environment.

Figure 2:
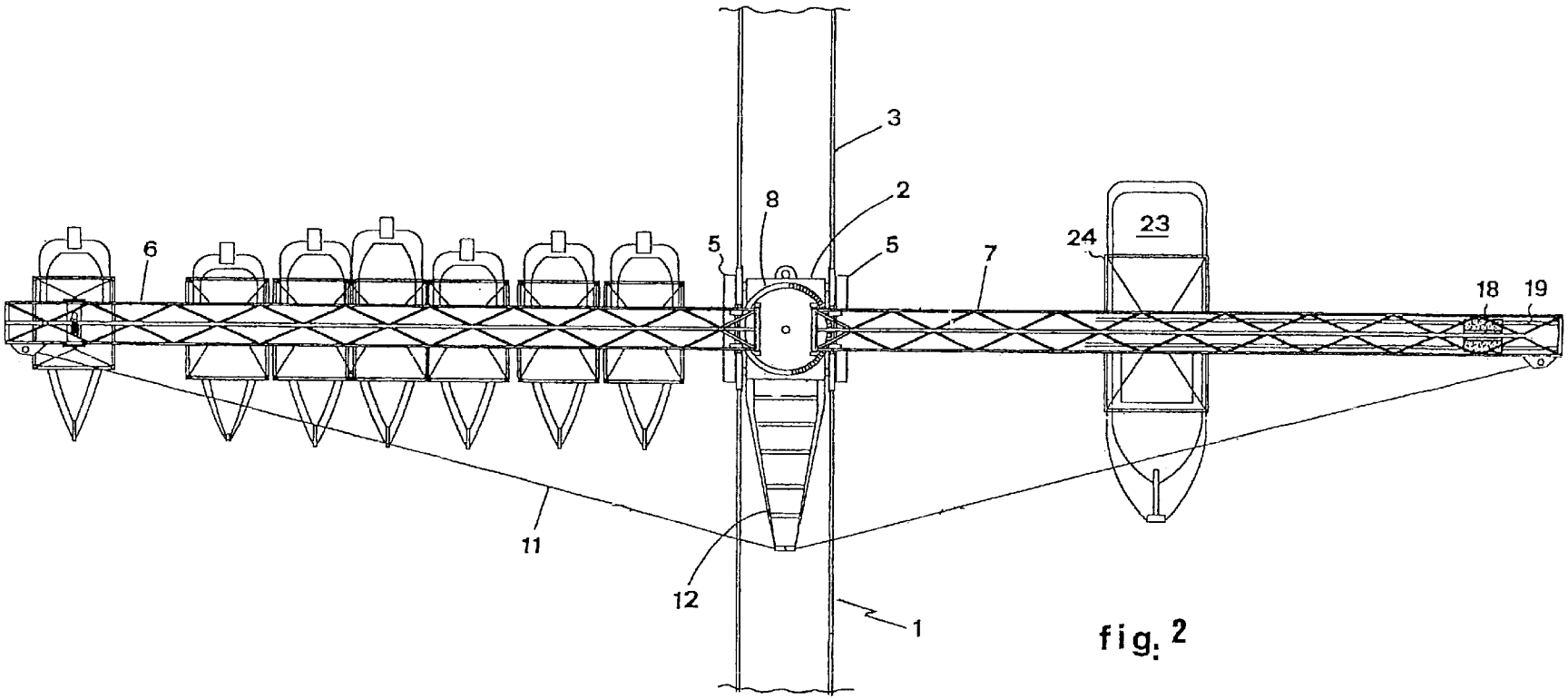
FIG. 2 is the view from the top of the trolley with trelliss structure of the arms and one portion of the pier.

Arms 6 and 7, the length of each one can reach several tens of meters, are equipped with tie rod 9, which converges towards tip 10 of the central tower of trolley 2. Its function is to discharge the weights hanging from arms 6 and 7 to the base of the same trolley 2 and therefore onto pier 1. At the same time said tie rod is used to activate the signal which indicates the loss of the horizontal position of the two arms 6 and 7 or of stress imbalance on the same tie rod when the load is not balanced. The arms are usually supplied with at least one horizontal tie rod 11 which, from a point of connection on each of said arms 6 and 7, it converges towards the tip of a shelf 12, which protrudes from trolley 2 and is oriented in the example reproduced in FIG. 2, in the direction in which pier 1 is placed. With said tie rod 11 the stress on arms 6 and 7 is balanced out, said stress would make the arms rotate in opposite directions, for example in case of strong winds or undulating movement of the harnessed boats.

Corresponding tie rod 9 which converges towards tip 10 of the central tower consists of a cable which slides into a groove on pulley 14, which is fixed on tip 10 of the central tower of trolley 2.

An imbalance of the load on arms 6 and 7 tends to cause their rotation on a vertical plane.

Said rotation, through tie rod 9 is transmitted to pulley 14, on whose axis, in the chosen solution, is applied an element 15 which is like a pointer that rotates together with the said pulley. Said pointer 15 is made to interact with two electric circuits. When it rotates in respect to the position of central balance, it closes one of the two circuits that activates the motor which commands the movements of counterweight saddle 18, until the horizontal position of the said arms and the stress balance of the two sides of tie rod 9 is not regained. The activation of one or the other electric circuit by pointer 15 commands the movement of the sliding counterweight 18 in one or the opposite direction on guides 19, housed inside arms 6 and 7, at least in the case in which the structure is a trelliss.

In order to avoid that even slight differences in the loads on arms 6 and 7 might determine the movement of sliding counterweight 18, the two sides of tie rod 9 converging towards tip 10 of the central tower of trolley 2 interact with resistant elastic means 20, which are made to contrast the sliding movement of tie rod 9 and therefore the rotation on a vertical plane of arms 6 and 7 connected to them.

In the solution reproduced in FIG. 3, said resistant elastic means 20 are formed by springs between structure 22, part of central tower of trolley 2, and flattening lever 24 part of pulley 14 and pointer 15 which commands the movement of sliding counterweight 18.

The small differences in loads 23 are therefore balanced out by the reaction of resistant elastic means 20 which contrast the rotation of pulley 14 and therefore also the sliding of tie rod 9. The differences above a maximum limit determine the contraction of one of the springs 20, the activation of one of the electric circuits by pointer 15, part of pulley 14, and the subsequent movement of the sliding counterweight 18 with which the imbalance of loads 23 on arms 6 and 7 is balanced out. Said arms are both equipped with a series of hoisting devices 21. Said hoisting devices are usually independent one from the other, therefore they can be activated independently from each other, so that the use of the machine is made even more flexible.

Said hoisting devices 21, of any of the known types, are distributed on the two arms 6 and 7 and each one is in a fixed position. In such a case they can have a dimension that will allow the hoisting of bigger loads towards the central body of trolley 2, and lighter loads by those placed towards the ends of arms 6 and 7.

Whereas, in one other practical example the hoisting devices 21 slide along a guide 28 which is part of arms 6 and 7, therefore they can take on different loading positions, also in consideration of the form and dimension of the boats 23 that need to be lifted.

Each one of said hoisting devices 21 is usually provided with its own motor to activate hoisting means 26, while in a control cabin, inside the hoisting machine or on land, there are the commands and the means for the activation of the dynamic parts of the same machine with which the controlled hoisting and releasing of hoisting means 26 are operated, the activation of the engines that command the movement of the sliding counterweight 18 of trolley 2 on pier 1, and also the activation of the engine that commands the rotations of trolley 2 on platform 8 that supports it and all those engine parts the machine will be equipped with.

When building the machine the details can be modified, as long as the functional logic of the machine is respected, as described in the following claims.

What is claimed is:

1. A hoisting machine for simultaneously transporting boats to and from land and water, comprising:

a fixed pier structure having a slide guide and a trolley slidably movable along the slide guide, the trolley having a central structure;

two arms connected to the trolley;

a plurality of hoisting devices distributed on said two arms;

a slidable counterweight in said two arms;

a tie rod having first and second parts that connect respective ones of said arms to said central structure; and an activation device that senses stresses in said parts of said tie rod and that directs movement of said counterweight in response to the sensed stresses in said parts of said tie rod.

2. A hoisting machine for simultaneously transporting a plurality of boats to and from land and water, comprising:

a fixed structure having a slide guide;

a trolley slidable along said slide guide, said trolley having a central structure;

first and second arms rotatably connected to said trolley;

a plurality of independently operable hoisting devices distributed on said first and second arms;

a counterweight slidable along at least one of said first and second arms;

an activation device directing movement of said counterweight; and a controller for controlling and activating said plural hoisting devices.

3. The hoisting machine as claimed in claim 2, further comprising stopping elements at first and second ends of said slide guide.

4. The hoisting machine as claimed in claim 2, further comprising a motor for independently powering said trolley for movement along said slide guide.

5. The hoisting machine as claimed in claim 2, wherein said trolley further comprises first and second reaction stabilizers extending along sides of said trolley in a longitudinal direction of said fixed structure.

6. The hoisting machine as claimed in claim 5, wherein said reaction stabilizers are counterweights.

7. The hoisting machine as claimed in claim 2, wherein said first and second arms are trellises each having a tie rod converging toward a tip of said central structure.

8. The hoisting machine as claimed in claim 2, wherein said trolley further comprises:

a shelf extending in a longitudinal direction of said fixed structure; and at least one tie rod extending from each of said first and second arms toward a summit of said shelf.

9. The hoisting machine as claimed in claim 2, wherein said plural hoisting devices are in a fixed position.

10. The hoisting machine as claimed in claim 2, wherein said plural hoisting devices are slidable along the first and second arms.

11. The hoisting machine as claimed in claim 2, further comprising a cabin mounted on the trolley and containing the controller and activation device.

12. A hoisting machine for simultaneously transporting plural loads to and from land and water, comprising:

a fixed structure having a trolley slide guide extending longitudinally along said fixed structure;

a trolley slidable along said trolley slide guide;

two arms rotatably connected to said trolley;

a plurality of hoisting devices distributed on each of said two arms;

a counterweight slidable along at least one of said two arms;

an activation device for directing movement of said counterweight; and a controller for controlling and activating said plural hoisting devices.

13. The hoisting machine as claimed in claim 12, wherein said plural hoisting devices are independently operable.

14. The hoisting machine as claimed in claim 12, wherein said plural hoisting devices are fixed.

15. The hoisting machine as claimed in claim 12, wherein said at least two arms comprise a hoist slide guide.

16. The hoisting machine as claimed in claim 15, wherein said plural hoisting devices are slidable along said hoist slide guide.

17. The hoisting machine as claimed in claim 12, wherein said activation device comprises:

a pulley;

a resistant elastic device opposing a rotation of said pulley; and a pointer rotatable with said pulley, said pointer being rotatable between first and second positions, when in said first position, said pointer indicating that said two arms are balanced, and when in said second position said pointer indicating that said two arms are out of balance, in said second position, said pointer activating said counterweight for movement to rebalance said two arms.

18. The hoisting machine as claimed in claim 17, further comprising a tie rod having a first end connected to one of said two arms and a second end connected to another one of said two arms, said tie rod frictionally engaging said pulley to rotate said pulley.

19. The hoisting machine as claimed in claim 12, wherein said plural loads are boats.

* * * * *